US006313819B1

(12) United States Patent
Maekawa et al.

(10) Patent No.: US 6,313,819 B1
(45) **Date of Patent: *Nov. 6, 2001**

(54) LIQUID CRYSTAL DISPLAY DEVICE

(75) Inventors: Toshikazu Maekawa; Yoshiharu Nakajima, both of Kanagawa (JP)

(73) Assignee: Sony Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/143,523

(22) Filed: Aug. 28, 1998

(30) Foreign Application Priority Data

Aug. 29, 1997 (JP) ..... 9-233519

(51) Int. Cl.[7] ..... G09G 3/36

(52) U.S. Cl. ..... 345/92; 345/100; 345/98; 345/89; 345/87

(58) Field of Search ..... 345/92, 98, 100, 345/212, 87, 206, 207; 313/505, 495, 496, 506; 330/270, 291

(56) References Cited

U.S. PATENT DOCUMENTS

| | | | | |
|---|---|---|---|---|
| 4,518,926 | | 5/1985 | Swanson | 330/253 |
| 4,697,154 | | 9/1987 | Kousaka et al. | 330/277 |
| 4,781,437 | | 11/1988 | Shields et al. | 345/98 |
| 5,061,920 | | 10/1991 | Nelson | 340/784 |
| 5,103,218 | | 4/1992 | Takeda | 345/100 |
| 5,196,738 | | 3/1993 | Takahara et al. | 345/89 |
| 5,266,936 | * | 11/1993 | Saitoh | 345/98 |
| 5,274,284 | * | 12/1993 | Krenik et al. | 307/475 |
| 5,361,041 | * | 11/1994 | Lish | 330/270 |
| 5,365,199 | * | 11/1994 | Brooks | 330/291 |
| 5,739,805 | | 4/1998 | Dingwall | 345/100 |
| 5,900,856 | | 5/1999 | Iino et al. | 345/100 |
| 5,907,314 | | 11/1999 | Negishi et al. | 345/100 |
| 5,977,940 | | 11/1999 | Akiyama et al. | 345/94 |
| 5,995,072 | | 11/1999 | Nakajima | 345/87 |
| 6,181,314 | * | 1/2001 | Nakajima et al. | 345/100 |

FOREIGN PATENT DOCUMENTS

| | | |
|---|---|---|
| 0 510 596 A1 | 10/1992 | (EP) . |
| 0510696 A1 | 10/1992 | (EP) . |
| 0597315 A2 | 5/1994 | (EP) . |
| 0657863 A2 | 6/1995 | (EP) . |
| 97/05596 | 2/1997 | (WO) . |

OTHER PUBLICATIONS

European Search Report dated Apr. 20, 2000.
"P–14: Low Output Offset, 8 bit Signal Drivers for XGA/SVGA TFT–LCDS"; I Minamizaki H Et Al; SID's International Display Research Conference; vol. Conf. 16, 1996, pp. 247–250.

* cited by examiner

*Primary Examiner*—Richard Hjerpe
*Assistant Examiner*—Ali A. Zamani
(74) *Attorney, Agent, or Firm*—Ronald P. Kananen; Rader, Fishman & Grauer

(57) ABSTRACT

In a source follower circuit having an NMOS source follower transistor with a drain thereof connected to a power supply and a current supply connected across the source of this transistor and earth, one end of a capacitor is connected to the gate of the transistor, the first analog switch is connected across the gate of the transistor and a precharge supply, the second analog switch is connected across the other end of the capacitor and the source of the transistor, and the third analog switch is connected across the other end of the capacitor and a signal source.

13 Claims, 8 Drawing Sheets

LIQUID CRYSTAL DISPLAY DEVICE

BACKGROUND OF THE INVENTION

The present invention relates to a liquid crystal display device, and more particularly relates to a source follower circuit constructed from a polysilicon thin film transistor (hereinafter referred to as a "polysilicon TFT" (Thin Film Transistor)) and an output circuit for the liquid crystal display device employing this source follower circuit as an output buffer.

Output buffers for charging each column line capacitor in a liquid crystal display device are generally constructed with voltage follower circuits employing operational amplifiers. However, in integrally forming a liquid crystal panel and a driver circuit thereof using polysilicon, complicated circuits for the operational amplifiers and variation in characteristics and large threshold voltage Vth of polysilicon TFTs make it difficult to form voltage follower circuits with polysilicon. This causes difficulty in integrally forming a liquid crystal panel and a driver circuit thereof with polysilicon.

It has therefore been considered to construct an output buffer using a source follower circuit of a simple circuit configuration. A simple source follower circuit configuration employing a polysilicon TFT is shown in FIG. 1. In FIG. 1, a source follower transistor 101 is in a connection used as a source follower and a drain of the source follower transistor 101 is connected to a power supply VCC and a gate is served as an input terminal. A source of the source follower transistor 101 is served as an output terminal and a current source 102 is connected across the source and ground.

In the source follower circuit of this configuration, an offset corresponding to a gate-source voltage Vgs of the source follower transistor 101 occurs across the input and output terminals. Namely, the output voltage Vout becomes as $$Vout=Vin-Vgs.$$

Since the offset potential Vgs is a function of variables such as the threshold voltage Vth of the transistor and the mobility of carriers $\mu$ as is described later, the output voltage Vout therefore varies due to variations in transistor characteristics.

The offset potential Vgs of a source follower circuit can generally be expressed by the following equation.

$$Vgs=Vth+\sqrt{Iref/k)}$$

and, $k=0.5\times\mu\times Cox\times W/L$ where, Iref is current of the current source 102, k is a constant, and Cox, W and L are a capacitance of a transistor oxidation film, gate width, and gate length, respectively.

As becomes clear from the above description, variation in the Vth of a transistor is substantial even for a source follower constructed with a polysilicon TFT, so that variation in output potential is also substantial. Therefore, when this circuit is used as an output buffer for charging each column line capacitor, there are large variations in output potential between the circuits. It is therefore difficult to employ a source follower circuit of the current configuration as an output buffer as it is for an integration of a liquid crystal panel and a driver using polysilicon.

In order to resolve the aforementioned problems, it is an object of the present invention to provide a liquid crystal display device having a source follower circuit with highly precise offset cancelling and an output circuit employing this source follower circuit.

SUMMARY OF THE INVENTION

The above object can be achieved by providing a liquid crystal display device comprising a source follower transistor in a connection used as a source follower; a capacitor with one end connected to the gate of the source follower transistor; a precharge supply; the first analog switch connected across the gate of the source follower transistor and the precharge supply; the second analog switch connected across the other end of the capacitor and the source of the source follower transistor, and operated simultaneously with the first analog switch; and the third analog switch connected across a signal source and the other end of the capacitor, and operated in reverse with respect to opening and closing operations of the first and second analog switches.

In the liquid crystal display device with the source follower circuit of the above configuration, in the precharge period, the first and second analog switches are turned on (closed) and the third analog switch is turned off (opened). A specific precharge voltage is then applied to the gate of the source follower transistor from the precharge supply via the first analog switch. At this time, a charge corresponding to an amount of offset Vos (=Vgs) is accumulated at a capacitor connected across the source and gate of the source follower transistor. After this, in the output period, the first and second analog switches are turned off and the third analog switch is turned on. The other side of the capacitor is then reconnected to a signal source and the gate of the source follower transistor is disconnected from the precharge supply. At this time, the gate potential of the source follower transistor becomes Vin+Vos. As a result, offset cancelling is carried out even when an offset Vos' corresponding to Vgs is generated because Vos' is given as Vos'=Vgs.

The liquid crystal display device of the present invention employs a source follower circuit of the above configuration as an output buffer for driving each column line. Highly precise offset cancelling can therefore be carried out with this source follower circuit even with circuits made of transistors such as polysilicon TFTs having a large threshold voltage Vth and having large amounts of variation in characteristics. Variations in output potential between each circuit can therefore be sufficiently reduced even when a plurality of circuits are lined up in parallel.

DESCRIPTION OF THE PREFERRED EMBODIMENTS

The following is a detailed description with reference to the drawings of the embodiments of the present invention.

Figure 2:
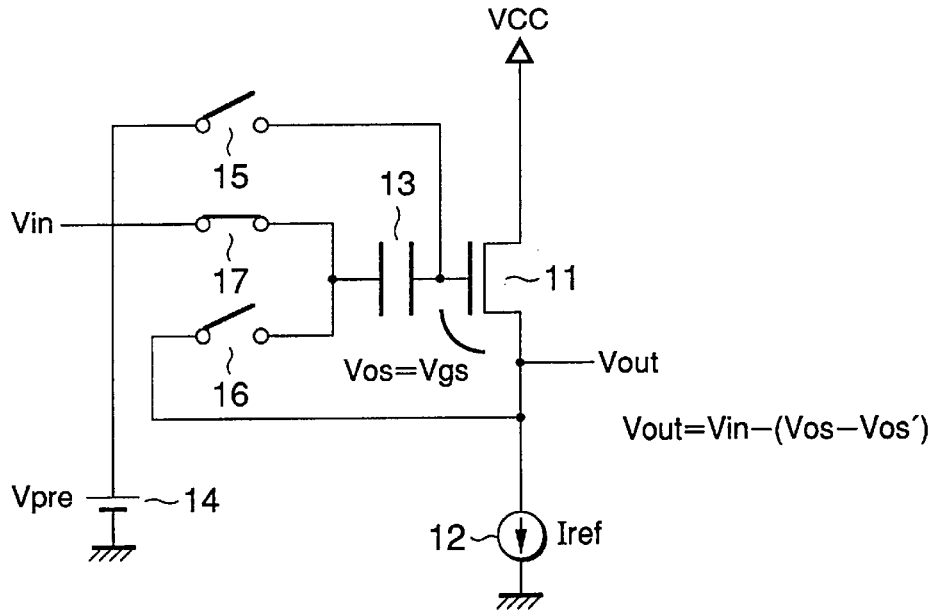
FIG. 2 is a circuit diagram showing the first embodiment of the source follower circuit according to the present invention.

In the first embodiment in FIG. 2, a source follower circuit has an NMOS source follower transistor 11 connected to a power supply VCC with the drain thereof and a current source 12 connected across the source of the source follower transistor 11 and earth. The gate of the source follower transistor 11 is connected to one end of a capacitor 13. The first analog switch 15 is connected across the gate of the source follower transistor 11 and a precharge supply 14. The second analog switch 16 is connected across the other end of the capacitor 13 and the source of the source follower transistor 11. The third analog switch 17 is connected across the other end of the capacitor 13 and a signal source (Vin).

The first analog switch 15 and the second analog switch 16 are simultaneously operated, i.e. turned on (closed) and off (open) in the same periods. The third analog switch 17 is operated in reverse with respect to the opening and closing of the first and second analog switches 15 and 16. Namely, the third analog switch 17 is off when the first and second analog switches 15 and 16 are on, and is on when the first and second analog switches 15 and 16 are off.

Figure 3:
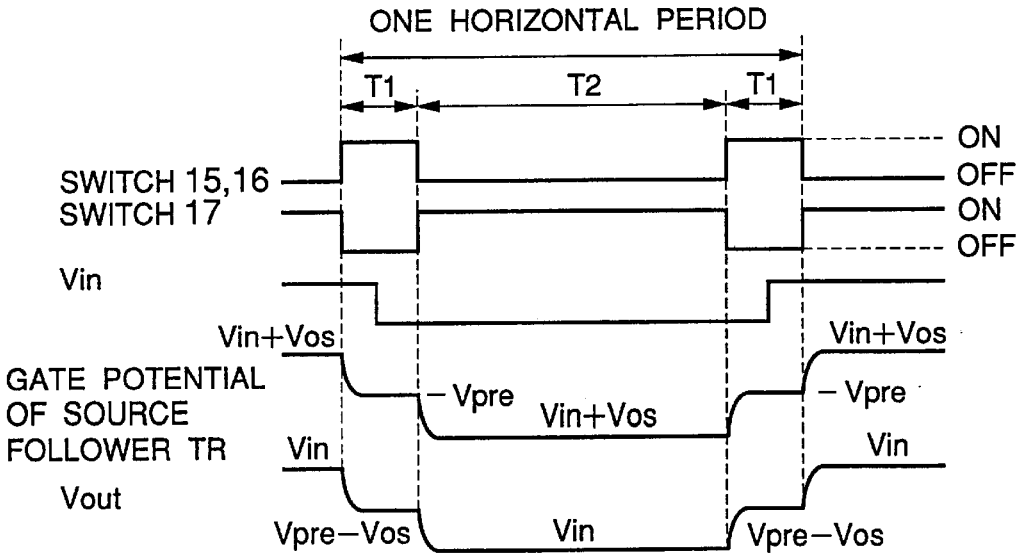
FIG. 3 is a timing chart illustrating operation of the first embodiment of the source follower circuit of FIG. 2.

A description is now given of the circuit operation of the source follower circuit of the first embodiment of the above configuration using a timing chart of FIG. 3.

First, in a precharge period T1, the first and second analog switches 15 and 16 are turned on and the third analog switch 17 is turned off. As a result, a specific precharge voltage Vpre is applied to the gate of the source follower transistor 11 from the precharge supply 14 via the first analog switch 15. At this time, a charge corresponding to an amount of offset Vos (=Vgs) is accumulated at the capacitor 13 connected across the gate and source of the source follower transistor 11.

After this, in an output period T2, the first and second analog switches 15 and 16 are turned off and the third analog switch 17 is turned on. As a result, the other end of the capacitor 13 (the source side of the source follower transistor 11) is reconnected to the side of the input signal Vin (signal source side) and the gate of the source follower transistor 11 is disconnected from the precharge supply 14. At this time, the gate potential of the source follower transistor 11 becomes equal to Vin+Vos.

As a result, even when an offset Vos' corresponding to the gate-source voltage Vgs of the source follower transistor 11 occurs, Vos' is given as Vos'=Vos and the offset is cancelled (i.e. Vos−Vos') to bring the output potential Vout at the output period T2 to become approximately the same potential as the input potential Vin. This then is equivalent to reduction of variations in output potential with respect to variations in the transistor characteristics.

In addition, it is not necessary to make output impedance of the signal source extremely small because precharging of the capacitor 13 can be carried out by the independent precharge supply 14 rather than by a signal source. This has great benefits when this source follower circuit is used as an output circuit for a reference voltage selection type DA converter within a horizontal driver of a liquid crystal display device. Namely, the line width of the reference voltage line can be made small, so that the whole circuit can be formed in a small area.

The effects given by the aforementioned circuit operation are particularly effective when the source follower circuit is constructed with a polysilicon TFT. That is, there is no substrate bias effect because polysilicon TFTs have no substrate potential. As a result, no change in the threshold voltage Vth occurs to enable accurate offset cancelling even when the input voltage (input potential of the source follower transistor 11) changes, and the output potential (source potential of the source follower transistor 11) changes. Parasitic capacitance at the side of one end of the first analog switch 15 (the gate side of the source follower transistor 11) becomes small because there is no substrate potential and the offset charge accumulated at the capacitor 13 is hardly discharged even when the base potential of the transistor 11 changes.

The source follower circuit constructed using a polysilicon TFT is, for example, used as an output buffer for charging each column line capacitor of a liquid crystal display device. This is particularly effective when used as an output buffer when a liquid crystal panel and a driver are integrally formed with polysilicon.

Figure 4:
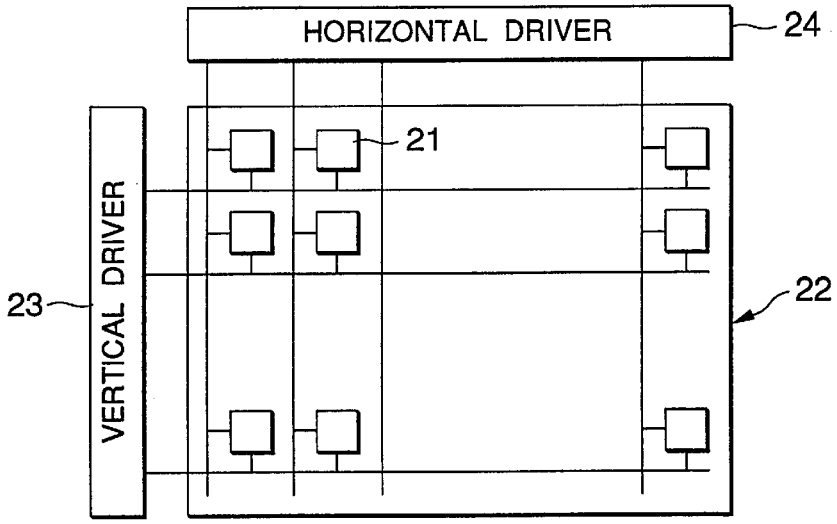
FIG. 4 is a schematic view showing an example of a configuration of a liquid crystal display device to which the present invention is applied.

FIG. 4 is a schematic view showing an example of a configuration of a liquid crystal display device to which the present invention is applied. In FIG. 4, a liquid crystal panel 22 is constructed by arranging liquid crystal cells (pixels) 21 two-dimensionally in a matrix shape, with a vertical (row) driver 23 for carrying out row selections and a horizontal (column) driver for carrying out column selections being provided at the periphery of the liquid crystal panel 22. The liquid crystal panel 22 and peripheral circuits thereof, namely the vertical driver 23 and the horizontal driver 24, are integrally formed of polysilicon.

Figure 5:
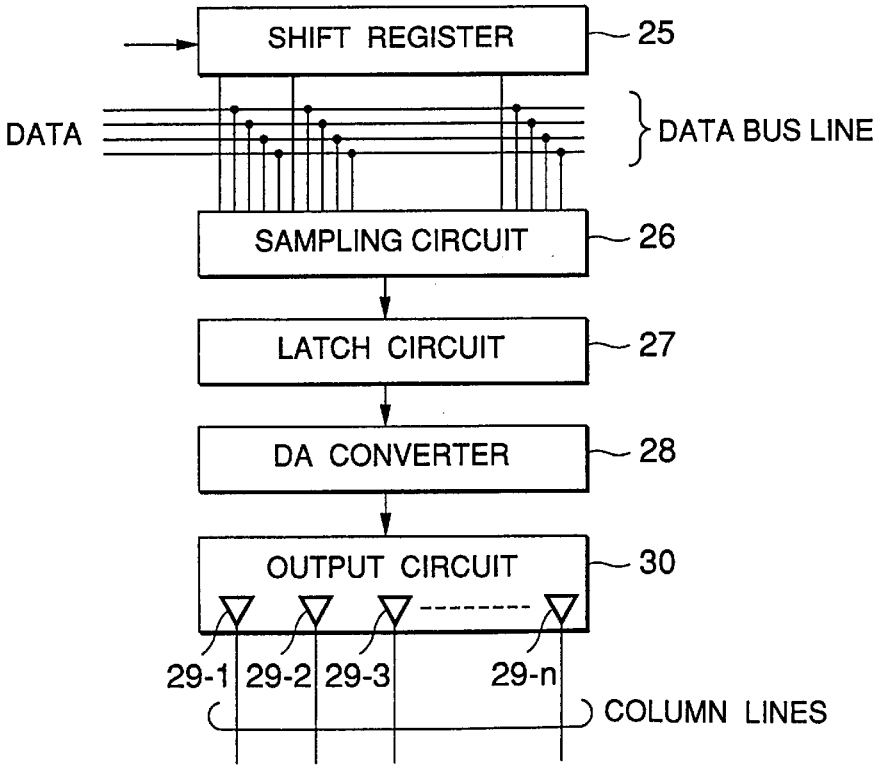
FIG. 5 is a block diagram showing an example of a configuration of a horizontal driver of the liquid crystal display device of FIG. 4.

FIG. 5 shows an example of a configuration of the horizontal driver 24. The horizontal driver 24 comprises a shift register 25 of a number of stages corresponding to the number n of column lines, a sampling circuit 26 for sampling data on a data bus line in synchronization with a sampling pulse outputted sequentially from the shift register 25, a latch circuit 27 for holding this data through one horizontal period, a DA converter 28 for converting this latched data into an analog signal, and an output circuit 30 consisting of n output buffers 29-1 to 29-n for driving each column line. The source follower circuit of the present invention is used at the horizontal driver 24 as output buffers 29-1 to 29-n.

Figure 6:
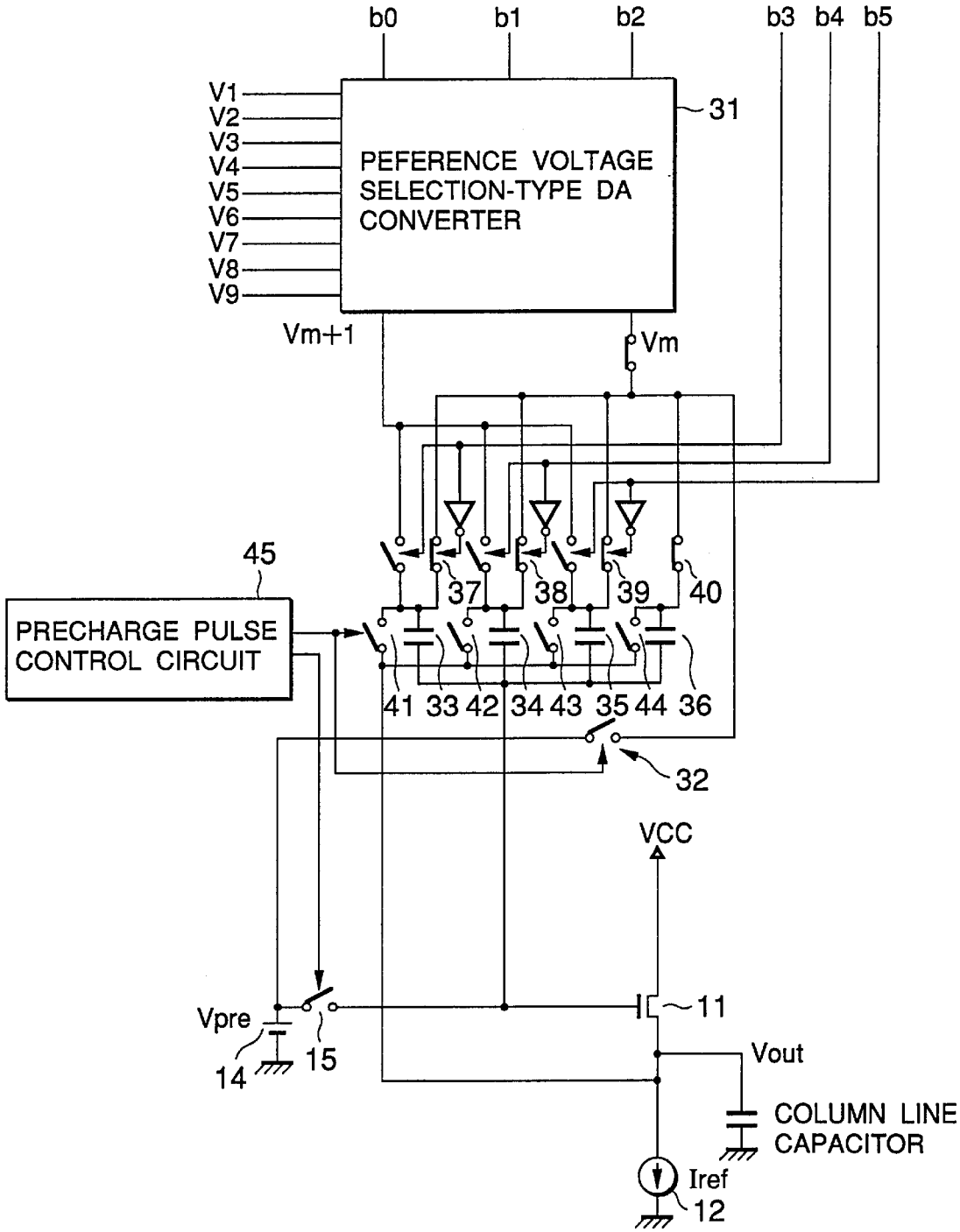
FIG. 6 is a circuit diagram showing an example in which the source follower circuit of the first embodiment is applied to the output buffer of a horizontal driver of a liquid crystal display device.

FIG. 6 is a circuit diagram showing an example of the source follower circuit of the first embodiment being applied to an output buffer, with the same numerals being given to portions that are the same as those in FIG. 2. In this example, the DA converter 28 provided at the stage previous to the output circuit 30 in FIG. 5 comprises a reference voltage selection-type DA converter 31 used for upper three bits of b0 to b2 and a switched capacitor array-type DA converter 32 used for lower three bits of b3 to b5. In this case a configuration is adopted where capacitors of the switched capacitor array-type DA converter 32 are shared as the capacitor 13 for offset charge accumulation for the source follower circuit of the first embodiment.

That is, a combined capacitance of four capacitors 33, 34, 35 and 36, provided so as to correspond to the lower three bits b3 to b5, respectively, with one end of each capacitor being connected in common to the gate of the source follower transistor 11, corresponds to the capacitor 13 for offset charge accumulation. A capacitance ratio of the four capacitors 33, 34, 35 and 36 is set to be 4:2:1:1. Further, four analog switches 41 to 44, each connected across the other end of each of the capacitors 33 to 36 and the source of the source follower transistor 11, correspond to the second analog switch 16 and four analog switches 37 to 40, connected across the other end of each of the capacitors 33 to 36 and the signal source, correspond to the third analog switch 17. Opening and closing of the analog switches 15, and 41 to 44 etc. is controlled by a precharge pulse control circuit 45.

Figure 1:
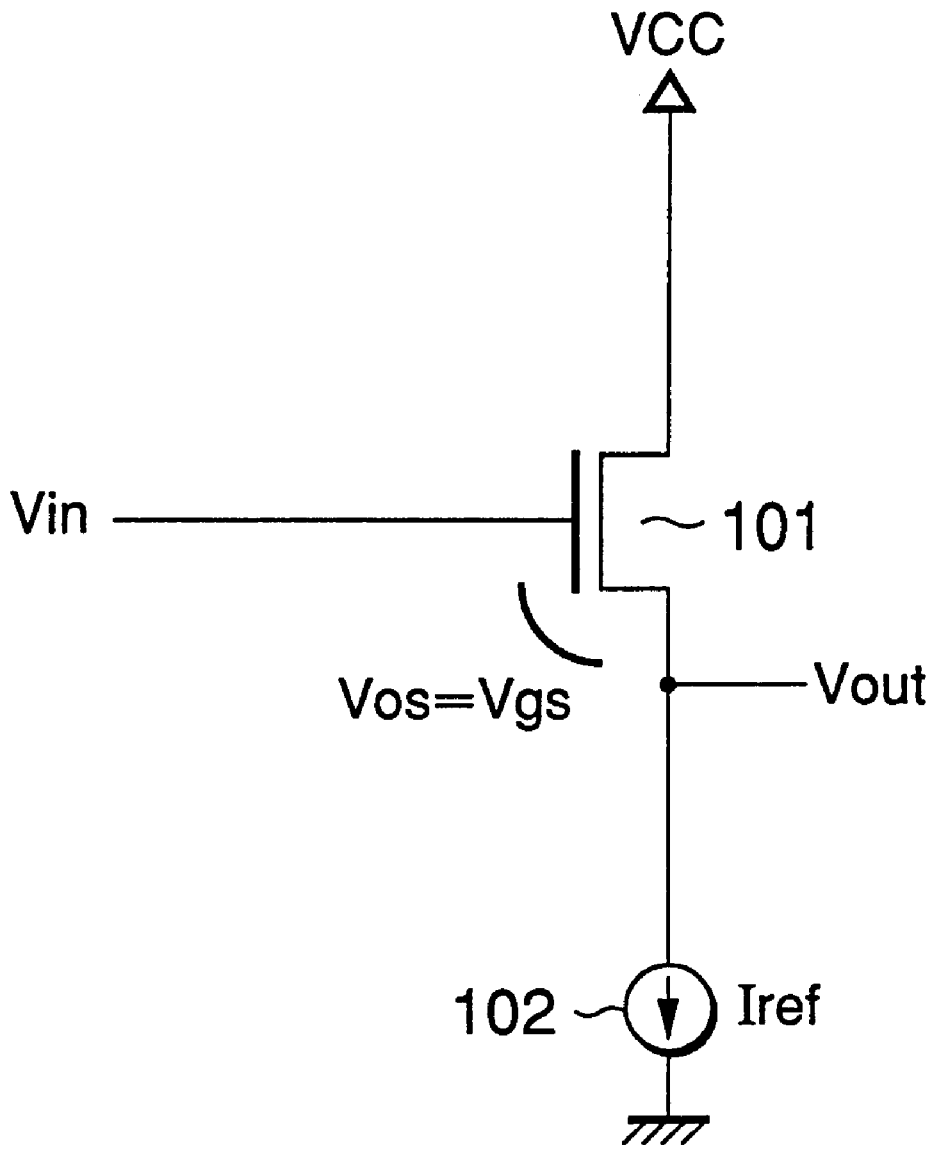
FIG. 1 is a circuit diagram showing an example of a conventional source follower circuit.

By employing the source follower circuit of the first embodiment as the output buffers 29-1 to 29-n in the horizontal driver 24 of the liquid crystal display device equipped with the DA converter 28 configured as a switched capacitor array type for the side of the lower three bits b3 to b5, the capacitor 13 for offset charge accumulation can be used as the capacitor for the switched capacitor array-type DA converter 32. The circuit can therefore be formed with only a few new circuit elements being required to be added to such a simple source follower circuit as shown in FIG. 1.

Figure 7:
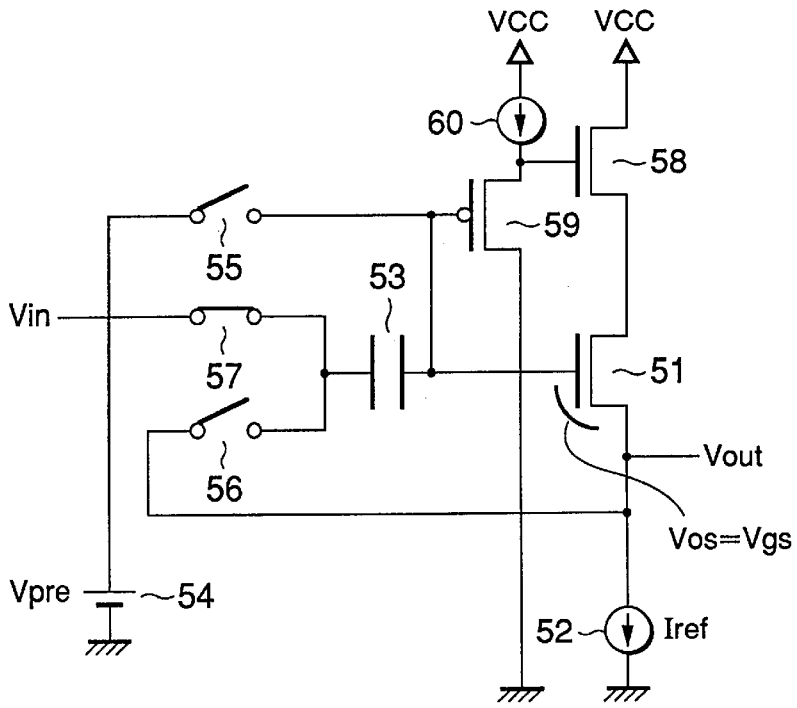
FIG. 7 is a circuit diagram showing the second embodiment of the source follower circuit according to the present invention.

FIG. 7 is a circuit diagram showing the second embodiment of the present invention. In this second embodiment, as in the first embodiment, one end of a capacitor 53 is connected to the gate of an NMOS source follower transistor 51, the first analog switch 55 is connected across the gate of the source follower transistor 51 and a precharge supply 54, the second analog switch 56 is connected across the other end of the capacitor 53 and the source of the source follower transistor 51, and the third analog switch 57 is connected across the other end of the capacitor 53 and the signal source (Vin). In addition to this configuration, an NMOS transistor 58 is cascode connected at the drain side of the source follower transistor 51, and a PMOS source follower transistor 59 is further provided with its gate connected to the gate of the source follower transistor 51 and its source connected to the gate of the cascode connected transistor 58. A current source 60 is connected across a power supply VCC and the common connection point of the gate of the cascode connected transistor 58 and the source follower transistor 59.

With the source follower circuit of the second embodiment of the above configuration, as with the operation of the source follower circuit of the first embodiment, the first and second analog switches 55 and 56 are turned on (closed) in the precharge period and off (open) in the output period, and the third analog switch 57 is turned off in the precharge period and on in the output period.

In the configuration of the first embodiment in which no NMOS transistor is cascode connected to the drain side of the source follower transistor 51, the operating point (in particular, the gate-drain voltage Vgd) of the source follower transistor 51 at the precharge period differs from that at the output period. The gate-source voltage Vgs1 in the precharge period therefore sometimes do not completely agree with the gate-source voltage Vgs2 in the output period due to the Vds (drain-source voltage)–Ids (drain-source current) characteristics of the MOS transistor and the offset corresponding to the amount of Vos–Vos' is sometimes left.

In this second embodiment, however, the gate-drain voltage Vgd of the source follower transistor 51 can be kept substantially fixed even in the precharge period as well as in the output period for outputting an arbitrary signal by cascode connecting the NMOS transistor 58 to the drain side of the source follower transistor 51 and connecting the PMOS source follower transistor 59 across the gate of the source follower transistor 51 and the gate of the cascode connected transistor 58.

This is because the drain voltage Vd of the source follower transistor 51 is a function of the gate voltage Vg, the gate-source voltage Vgs58 of the cascode connected transistor 58 and the gate-source voltage Vgs59 of the source follower transistor 59 which can be expressed as $$Vd=Vg+Vgs59-Vgs58,$$

and the drain voltage Vd of the source follower transistor 51 therefore changes in response to the change in the gate voltage Vg thereof.

Compared with the circuit configuration of the first embodiment, fluctuations in the drain voltage of the source follower transistor 51 can be reduced by a factor of the voltage gain of the cascode connected transistor 58 in common-source connection. This can reduce input/output offset variations due to variation in the operating point of the source follower transistor 51. Variations in output potential due to variations in transistor characteristics can therefore be further reduced.

The operation of the source follower circuit of the second embodiment is the same as the operation of the source follower circuit of the first embodiment based on the timing chart of FIG. 3. The advantage of the above circuit configuration is particularly successful when the source follower circuit is formed with polysilicon TFTs. The reason for this is the same as that described in the first embodiment.

Figure 8:
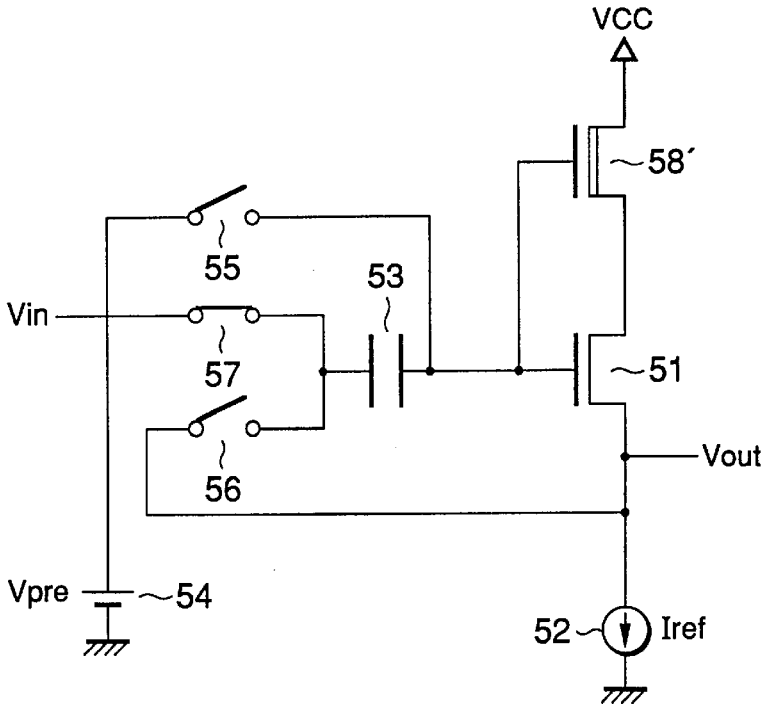
FIG. 8 is a circuit diagram showing an example of a modification of the second embodiment of FIG. 7.

FIG. 8 is a circuit diagram showing an example of a modification of the second embodiment. In the figure, portions that are the same as in FIG. 7 are shown with the same numerals. In this modified example, a configuration is adopted where a depletion-type transistor 58' is used as the transistor 58 cascode connected to the side of the drain of the source follower transistor 51.

Since a depletion type transistor has a negative threshold voltage Vth, the drain voltage of the source follower transistor 51 can then be made to follow the gate voltage Vg thereof even in a configuration where just one stage of a source follower is connected across the gate and drain of the source follower transistor 51. According to this circuit configuration, the source follower transistor 59 of the circuit configuration of the second embodiment in FIG. 7 can be omitted to provide an advantage that the circuit area can therefore be reduced by this amount.

Figure 9:
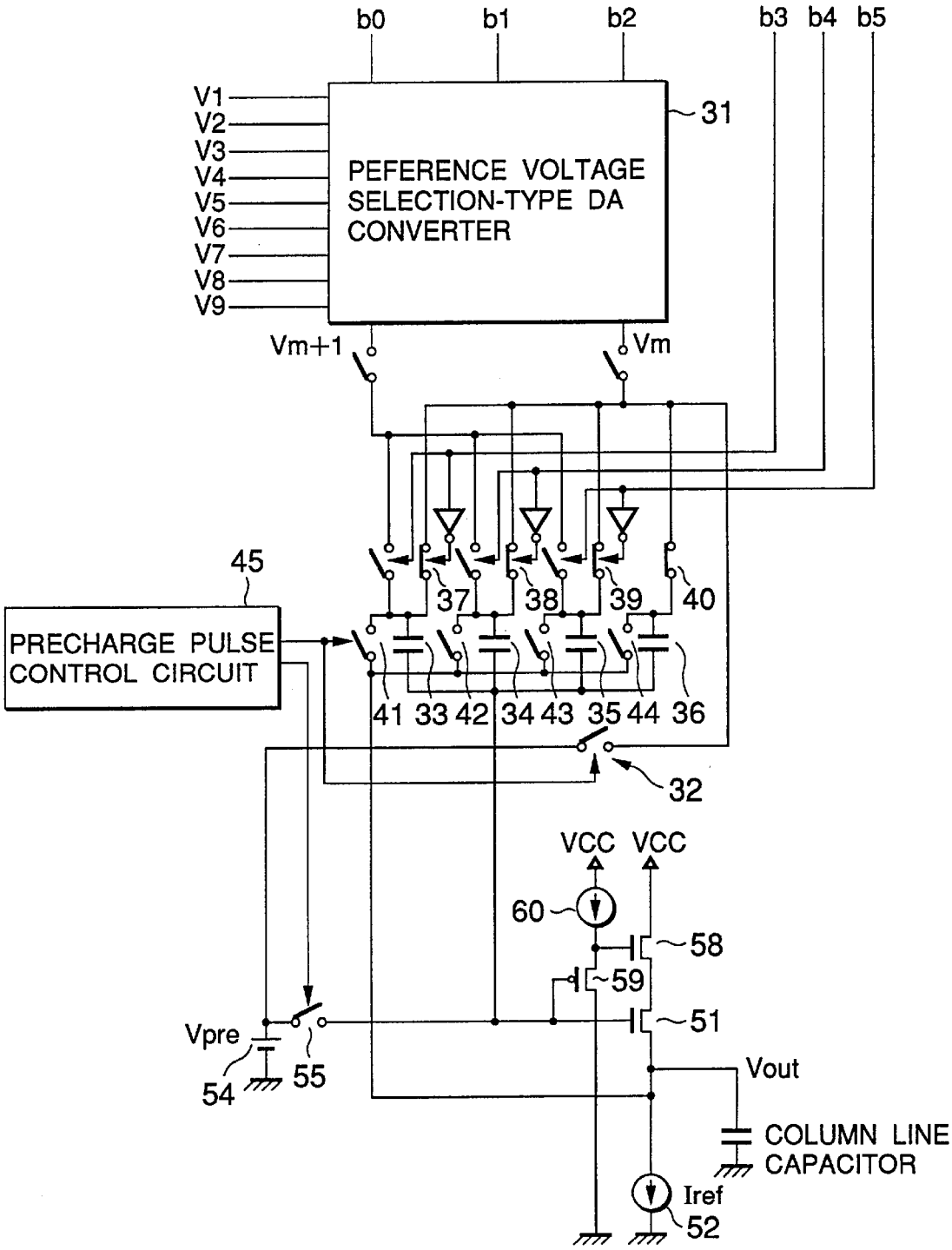
FIG. 9 is a circuit diagram showing an example in which the source follower circuit of the second embodiment is applied to the output buffer of a horizontal driver of a liquid crystal display device.

FIG. 9 is a circuit diagram showing an example where the source follower circuit of the second embodiment is applied to the output buffer of a horizontal driver of a liquid crystal display device, with portions that are the same as for FIG. 7 being shown with the same numerals. In this example, as with the example of the first embodiment, the DA converter 28 of the previous stage comprises a reference voltage selection-type DA converter 31 used for the upper three bits b0 to b2 and a switched capacitor array-type DA converter 32 used for the lower three bits b3 to b5, where the capacitors of the switched capacitor array-type DA converter 32 are shared as the capacitor 53 for offset charge accumulation for the source follower circuit of the second embodiment. The advantage of this configuration is the same as that of the example of the first embodiment.

Figure 10:
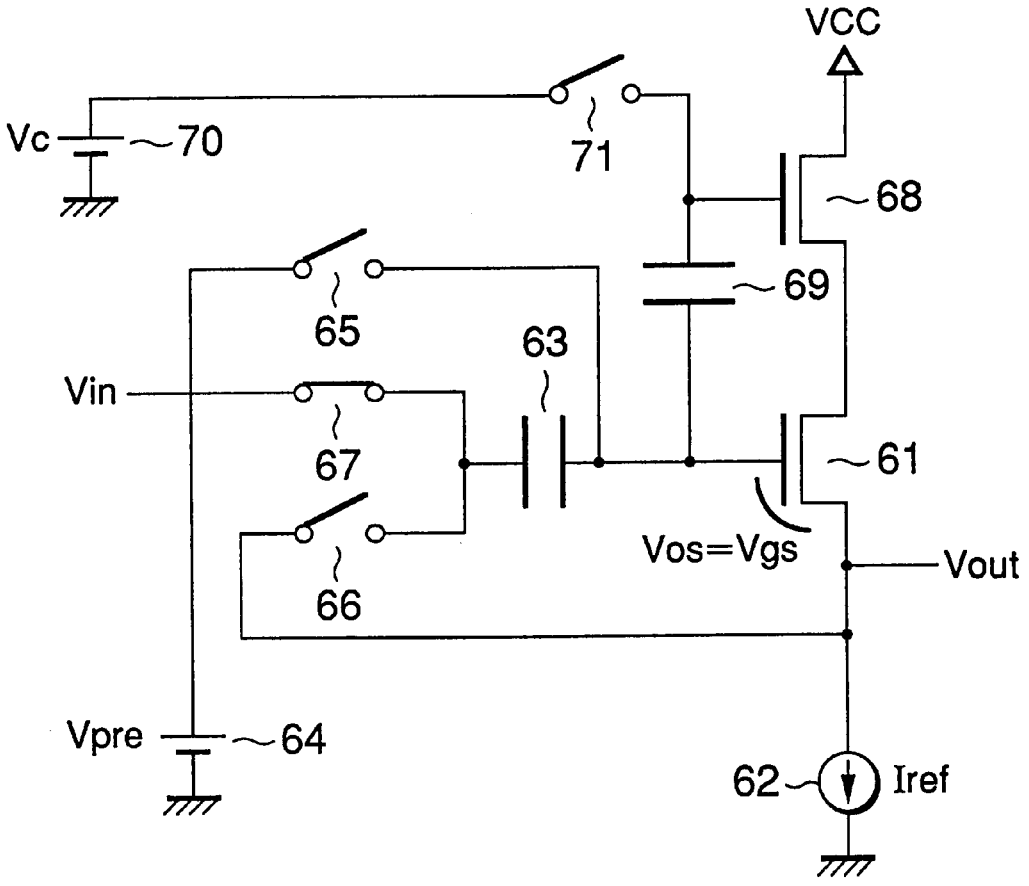
FIG. 10 is a circuit diagram showing the third embodiment of the source follower circuit according to the present invention.

FIG. 10 is a circuit diagram showing the third embodiment of the present invention. In this third embodiment, as with the first embodiment, one end of a capacitor 63 is connected to the gate of an NMOS source follower transistor 61, the first analog switch 65 is connected across the gate of the source follower transistor 61 and a precharge supply 64, the second analog switch 66 is connected across the other end of the capacitor 63 and the source of the source follower transistor 61, and the third analog switch 67 is connected across the other end of the capacitor 63 and the signal source (Vin). In addition to this configuration, an NMOS transistor 68 is cascode connected to the drain side of the source follower transistor 61, a capacitor 69 is connected across the gate of the source follower transistor 61 and the gate of the cascode connected transistor 68, and the fourth analog switch 71 is connected across the gate of the cascode connected transistor 68 and an electric supply 70 of a specific voltage value Vc.

As with the operation of the source follower circuit of the first embodiment, with the source follower circuit of the third embodiment of the above configuration, the first and second analog switches 65 and 66 are turned on (closed) in the precharge period and off (open) in the output period, and the third analog switch 67 is turned off in the precharge period and on in the output period. The fourth analog switch 71 is further operated simultaneously with the first and second analog switches 65 and 66 so as to be turned on in the precharge period and off in the output period.

The voltage value Vc of the electric supply 70 is set to be a value that is shifted by a certain amount with respect to the voltage value of the precharge voltage Vpre of the source follower transistor 61. The amount of the shift is obtained from the saturation conditions of the source follower transistor 61 and the cascode connected transistor 68. It is also possible to use a source follower inputted with the gate potential of the source follower transistor 61 in place of the voltage value Vc of the electric supply 70.

In the above configuration, the operation for cancelling the voltage difference across the input and output is the same as that of the first embodiment based on the timing chart of FIG. 3. That is, the operation is carried out so that opening and closing operation of the first and second analog switches 65 and 66 is controlled so that it is in reverse with respect to that of the third analog switch 67, the capacitor 63 is connected across the input (gate) and output (source) of the source follower transistor 61 in the precharge period so that a charge corresponding to the gate-source voltage Vgs of the transistor 61 is accumulated, and the source side of this capacitor 63 is reconnected to the input in the output period.

In addition to the above operation, in this embodiment the gate of the cascode connected transistor 68 is precharged to the voltage value Vc by turning the fourth analog switch 71 on in the precharge period. The gate of the cascode connected transistor 68 is then disconnected from the electric supply 70 by turning the fourth analog switch 71 off in the output period.

The gate potential of the cascode connected transistor 68 can be set to be higher than a power supply voltage VCC by the circuit operation accompanied by the on/off operation of the fourth analog switch 71. The drain voltage of the source follower transistor 61 can therefore be made higher compared with those in the circuit configurations of the first and second embodiments. As a result, the range of the drain voltage of the transistor 61 can be made greater and the dynamic range of the output can be expanded even in configurations with source follower circuits where transistors such as polysilicon TFTs etc. are employed as the source follower transistors 61, in which the threshold voltage Vth is high and variations in characteristics are large.

Since the gate-drain voltage Vgd of the source follower transistor 61 is kept substantially fixed even in the precharge period and the output period as in the case of the circuit configuration of the second embodiment, highly precise offset cancelling can be carried out to reduce variations in output potential due to variations in transistor characteristics. The advantage of the above circuit configuration is particularly successful when the source follower circuits are formed with polysilicon TFTS. The reason for this is the same as that described in the first embodiment.

Figure 11:
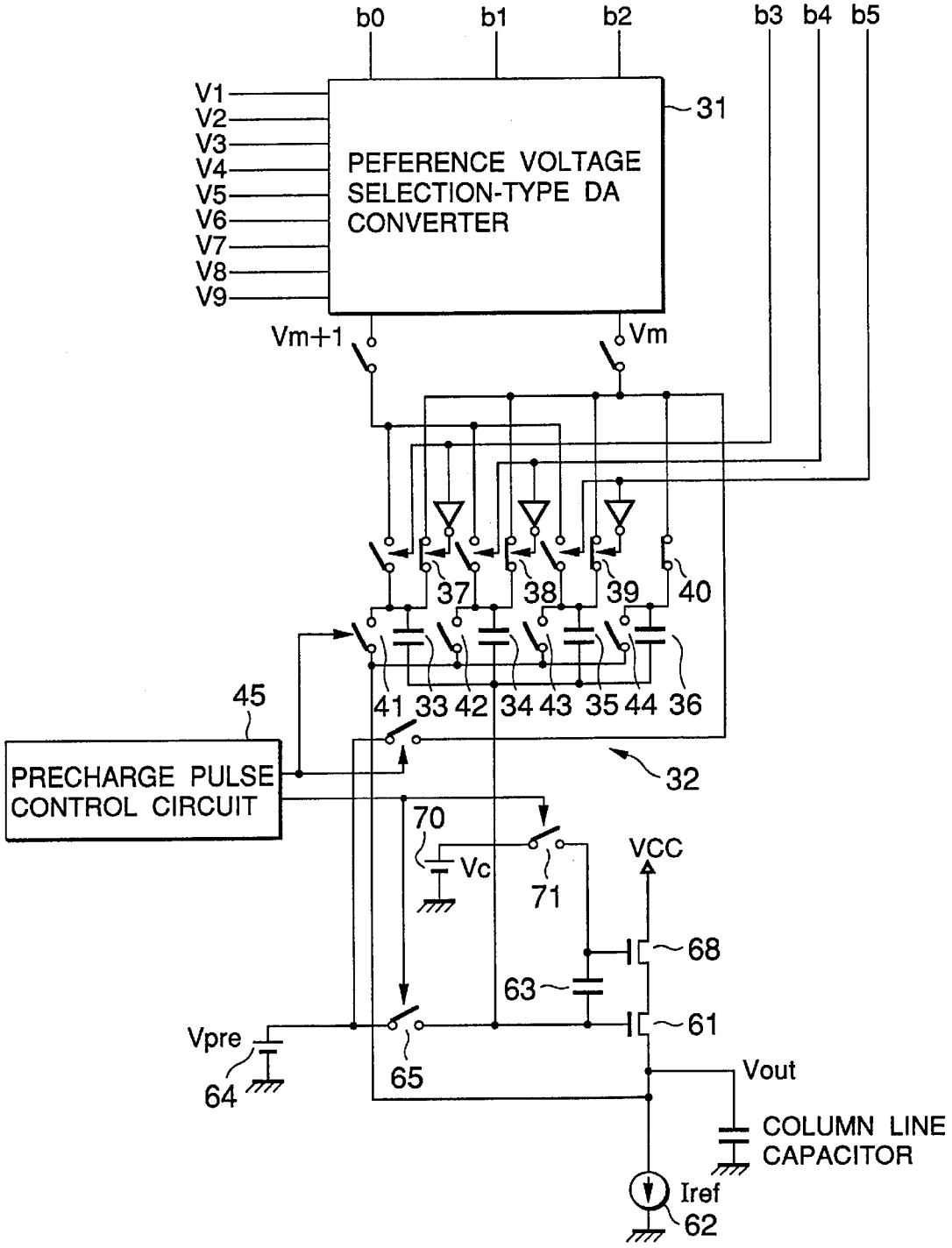
FIG. 11 is a circuit diagram showing an example in which the source follower circuit of the third embodiment is applied to the output buffer of a horizontal driver of a liquid crystal display device.

FIG. 11 is a circuit diagram showing an example where the source follower circuit of the third embodiment is applied to the output buffer of a horizontal driver of a liquid crystal display device. Portions that are the same as for FIG. 10 are shown with the same numerals. As in the examples of the first and second embodiments, the DA converter 28 of the previous stage comprises a reference voltage selection-type DA converter 31 used for the upper three bits b0 to b2 and a switched capacitor array-type DA converter 32 used for the lower three bits b3 to b5, where the capacitors of the switched capacitor array-type DA converter 32 are shared as the capacitor 63 for offset charge accumulation for the source follower circuit of the third embodiment. The advantage of this configuration is the same as that of the example of the first embodiment.

In the first to third embodiments, a description is given of applications to NMOS source follower circuits where NMOS transistors are employed as source follower transistors, but applications are also possible to opposite type PMOS source follower circuits.

As described above, according to the present invention, highly precise offset cancelling is possible by adopting a configuration for carrying out a precharge operation, where one end of a capacitor is connected to the gate of a source follower transistor, the first analog switch is connected across the gate of the source follower transistor and a precharge supply, the second analog switch is connected across the other end of the capacitor and the source of the source follower transistor, and the third analog switch is connected across the other end of the capacitor and a signal source.

By using the source follower circuit according to the present invention as an output buffer for driving each column line in an output circuit of a liquid crystal display device, highly precise offset cancelling is possible even for circuits made using transistors such as polysilicon TFTs with a large threshold voltage Vth and large variations in characteristics. Variations in output potential between each circuit can therefore be sufficiently reduced even when a plurality of circuits are lined up in parallel. This is particularly advantageous when used as an output buffer with which a liquid crystal panel and a driver part thereof are integrally formed with polysilicon.

What is claimed is:

1. A liquid crystal display device comprising:

a source follower transistor in a connection used as a source follower;

a capacitor with one end connected to the gate of said source follower transistor;

a precharge supply;

a first analog switch connected across said gate of said source follower transistor and said precharge supply;

a second analog switch connected across the other end of said capacitor and the source of said source follower transistor, and operated simultaneously with said first analog switch; and a third analog switch connected across a signal source and the other end of said capacitor, and operated in reverse with respect to opening and closing operations of said first and second analog switches.

2. The liquid crystal display device of claim 1, wherein said source follower transistor is a polysilicon thin film transistor.

3. The liquid crystal display device of claim 1, wherein said first and second analog switches are turned on during a precharge period and turned off during an output period, and said third analog switch is turned off during said precharge period and turned on during said output period.

4. The liquid crystal display device of claim 1 further comprising a cascode connected transistor cascode connected to the drain side of said source follower transistor with a gate side thereof connected to said gate side of said source follower transistor.

5. The liquid crystal display device of claim 4 further comprising a transistor of an opposite conduction type to the conduction type of said cascode connected transistor, said transistor having a source connected to said gate of said cascode connected transistor and a gate connected to said gate of said source follower transistor.

6. The liquid crystal display device of claim 4, wherein said cascode connected transistor is a depletion type transistor.

7. The liquid crystal display device of claim 4 further comprising:

a capacitor connected across said gate of said source follower transistor and said gate of said cascode connected transistor; and a fourth analog switch connected across said gate of said cascode connected transistor and a prescribed electric source, and operated simultaneously with said first and second analog switches.

8. A liquid crystal display device comprising a plurality of output buffers for driving respective column lines, each of said output buffers comprising:

a source follower transistor in a connection used as a source follower;

a capacitor with one end connected to the gate of a source follower transistor;

a precharge supply;

a first analog switch connected across said gate of said source follower transistor and said precharge supply;

a second analog switch connected across the other end of said capacitor and the source of said source follower transistor, and operated simultaneously with said first analog switch; and a third analog switch connected across a signal source and the other end of said capacitor, and operated in reverse with respect to opening and closing operations of said first and second analog switches.

9. The liquid crystal display device of claim 8 further comprising a DA converter of a reference voltage selection type for upper bits and a DC converter of a switched capacitor array type for lower bits, both of said DA converters being provided at a stage previous to said output buffers, and said DA converter of said switched capacitor array type having capacitors being shared as said capacitor connected to the gate of said source follower transistor.

10. The liquid crystal display device of claim 8 further comprising a cascode connected transistor cascode connected to said drain side of said source follower transistor with a gate side thereof connected to said gate side of said source follower transistor.

11. The liquid crystal display device of claim 10 further comprising a DA converter of a reference voltage selection type for upper bits and a DA converter of a switched capacitor array type for lower bits, both of said DA converters being provided at a stage previous to said output circuit, and said DA converter of said switched capacitor array type having capacitors being shared as said capacitor connected to the gate of said source follower transistor.

12. The liquid crystal display device of claim 10 further comprising:

a capacitor connected across said gate of said source follower transistor and said gate of said cascode connected transistor; and a fourth analog switch connected across said gate of said cascode connected transistor and a prescribed electric supply, and operated simultaneously with said first and second analog switches.

13. The liquid crystal display device of claim 12 further comprising a DA converter of a reference voltage selection type for upper bits and a DA converter of a switched capacitor array type for lower bits, both of said DA converters being provided at a stage previous to said output circuit, and said DA converter of said switched capacitor array type having capacitors being shared as said capacitor connected to the gate of said source follower transistor.

* * * * *